US006333465B1

(12) United States Patent
Prudhon

(10) Patent No.: US 6,333,465 B1
(45) Date of Patent: Dec. 25, 2001

(54) DATA TRANSMISSION CABLE

(75) Inventor: Daniel Prudhon, Saint Leu la Foret (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/198,054

(22) Filed: Nov. 23, 1998

(30) Foreign Application Priority Data

Nov. 27, 1997 (FR) ..... 97 14910

(51) Int. Cl.[7] ..... H01B 7/00; H01B 11/02; H01B 11/06

(52) U.S. Cl. ..... 174/110 R; 174/113 R; 174/117 F; 174/36

(58) Field of Search ..... 174/117 F, 117 FF, 174/113 R, 110 R, 36, 120 R, 120 AR

(56) References Cited

U.S. PATENT DOCUMENTS

| | | | | |
|---|---|---|---|---|
| 4,277,642 | * | 7/1981 | Piper et al. | 174/117 F |
| 5,483,020 | | 1/1996 | Hardie et al. | 174/36 |
| 5,493,071 | * | 2/1996 | Newmoyer | 174/113 R |
| 5,519,173 | * | 5/1996 | Newmoyer | 174/113 R |
| 5,565,653 | * | 10/1996 | Rodidal et al. | 174/113 R |
| 5,619,016 | * | 4/1997 | Newmoyer | 174/113 R |
| 5,739,473 | * | 4/1998 | Zerbs | 174/121 A |
| 5,883,334 | * | 3/1999 | Newmoyer et al. | 174/113 R |
| 5,932,847 | * | 8/1999 | Mayfield | 174/113 R |
| 5,936,205 | * | 8/1999 | Newmoyer | 174/113 R |

FOREIGN PATENT DOCUMENTS

| | | |
|---|---|---|
| 0 599 672 A1 | 6/1994 | (EP) . |
| WO 97/23883 | 7/1997 | (WO) . |

OTHER PUBLICATIONS

Engineering Design Guide (3rd Edition), C & M Corporation Wire and Cable, Jan. 1992, pp. 1–68.*
Belden Technical Papers, Steve Lampen, Wire, Cable, and Fiber Optics, Jun. 17, 2000, pp. 1–21.*

* cited by examiner

*Primary Examiner*—Dean A. Reichard
*Assistant Examiner*—William H Mayo, III
(74) *Attorney, Agent, or Firm*—Sughrue, Mion, Zinn, Macpeak & Seas, PLLC

(57) ABSTRACT

A data transmission cable having at least one unit of at least four conductors twisted into sets of conductors, which sets are quads or pairs, each conductor set being twisted at a pitch that is different from the pitch of any other conductor set, and each conductor being insulated by an insulating sheath. The unit being covered by at least one assembly structure, wherein the material used for the insulating sheath of any conductor in a given set of conductors has a relative dielectric constant that is different from that of the material used for the insulating sheath of any conductor in another set of conductors, such that the propagation time differences between the conductors of the set of conductors and the conductors of the other set of conductors is less than 2 ns/100 m.

25 Claims, 1 Drawing Sheet

DATA TRANSMISSION CABLE

The present invention relates to a data transmission cable. It relates more particularly to such a cable for use in the field of computing or in the field of telephony.

BACKGROUND OF THE INVENTION

European patent EP-B-0 599 672 describes a high frequency signal transmission cable comprising at least one conductor unit. Each unit has at least two sets of conductors, such as a quad of twisted conductors, each conductor being insulated by a first insulating sheath. The unit, or a plurality of said units, are surrounded by a second sheath constituted by a thin extruded covering of insulating material situated in contact with the conductors or the set of conductors without said conductors being embedded in the sheath constituted by the covering. The insulating material simultaneously provides sufficient stiffness to hold said conductors in a determined position while said cable is being handled, and sufficient elasticity to make such handling possible.

Unfortunately, to obtain a level of cross-talk that is compatible with good transmission in a cable comprising at least one unit of at least four twisted conductors in the form of sets of conductors that are pairs or quads, the twist pitches of said sets of conductors must be different. The problem for data transmission is that given that each set of conductors has a different electrical length, signals applied simultaneously at one end of the cable to each of said sets of conductors reach the other end of the cable with relative time shifts. The problem becomes particularly troublesome when data transmission rates are high.

At present, this difference is compensated by active equipments associated with passive buffer memories or "buffers". These memories are expensive, and the storage capacity they require is becoming ever greater.

Thus, the problem which arises is that of mitigating the transmission time differences between conductors in a given set of conductors, and the conductors in another set of conductors, said sets of conductors being situated in a unit of a data transmission cable. The object of the present invention is to make a data transmission cable which solves the problem posed in that it enables propagation time differences between the conductors of said sets of conductors to be reduced considerably, i.e. it makes it possible in general to obtain such propagation time differences that are less than two nanoseconds per hundred meter length of cable (2 ns/100 m).

SUMMARY OF THE INVENTION

To this end, the invention provides a data transmission cable comprising at least one unit of at least four conductors twisted into sets of conductors, which sets are quads or pairs, each conductor set being twisted at a pitch that is different from the pitch of any other conductor set, and each conductor being insulated by means of an insulating sheath, said unit being covered by at least one assembly means, wherein the material used for the insulating sheath of any conductor in a given set of conductors has a relative dielectric constant that is different from that of the material used for the insulating sheath of any conductor in another set of conductors, such that the propagation time differences between the conductors of said set of conductors and the conductors of the other set of conductors is less than 2 ns/100 m.

A preferred embodiment is such that said unit comprises eight conductors in the form of two quads or four pairs.

Said cable of the invention is advantageously such that said assembly means comprises at least one "unit" sheath situated in contact with the conductors of the sets of conductors.

Thus, when the unit is in the form of quads of twisted conductors, the material used for the insulating sheath of each conductor in the first quad has a relative dielectric constant that is different from that of the material used for the insulating sheath of each conductor in the second quad.

Likewise, when the unit is in the form of four pairs (or two pairs) of twisted conductors, the material used for the insulating sheath of each conductor in the first pair has a relative dielectric constant that is different from that of the material used for the insulating sheath of each conductor in each of the other three pairs (or the other pair).

Advantageously, the material used for the insulating sheath of any conductor in a set of conductors of a cable unit of the invention, selected from materials having a relative dielectric constant suitable for making the cable of the invention, has low internal molecular mobility. This molecular mobility is known, it is due to greater or lesser dipole polarity within the material, depending on the nature of a given material, and it is represented by the tangent value $\delta$. Typically, this value is less than about $5\times10^{-4}$ at 100 kHz for a material used as the insulating sheath of a conductor in a set of conductors present in a cable unit of the invention.

To obtain a cable of the invention, it is necessary to have materials that possess different relative dielectric constants, so as to be capable of making the insulating sheaths of all of the conductors of a given set of conductors out of the same given material, and the insulating sheaths of the conductors in all of the other sets of conductors out of other materials.

The insulating sheath of any conductor in a given set of conductors is thus made out of a given material which is different from the insulating materials used for the insulating sheaths of the conductors in the other sets of conductors: each set of conductors twisted at a given pitch is associated with one and only one insulating sheath material in unique manner. The materials used for making the insulating sheaths of all of the conductors in a given set of conductors are thus different materials, being selected for their different dielectric constants, or else they are materials of the same kind but possessing different relative dielectric constants.

By way of example, the materials can be selected from various types of polyethylene materials which, at present, provide a range of relative dielectric constants extending approximately from 1.6 to 2.3, with higher density polyethylene having a dielectric constant of about 2.3, and expanded materials such as expanded polyethylene or expanded polypropylene having a relative dielectric constant of about 1.6. The tangent $\delta$ of this type of material is typically of the order of $10^{-7}$ to $10^{-6}$ at 100 kHz. A selection can also be made of expanded materials that are synthesized in a manner that is conventional to the person skilled in the art using the "foam skin" technique. Said expanded materials possess a cellular insulating material of very low dielectric constant, of about 1.3 to 1.4 approx., such as cellular polyethylene, said cellular insulating material being surrounded by a protective "skin" layer of solid polyethylene having a higher dielectric constant, of about 2.0 approx., and the thickness of such a layer is typically about 50 $\mu$m. Finally, a selection can also be made from by way of example of various fluorine-containing polymers such as polytetrafluoroethylene (PTFE), polychlorotrifluoroethylene (PCTFE), polyvinylidine fluoride (PVDF), perfluorinated poly(ethylene-propylene) (PEP), ethylene trichlorofluoroethylene (ETCFE) and ethylene-PTFE copolymer (ETFE) which possess relative dielectric constants of about 2 to 2.6 approx., and on average tangent δ values of less than about $5\times10^{-4}$ at 100 kHz.

As is known to the person skilled in the art, the sets of conductors present in the cable unit of the invention possessing the property of having a different dielectric constant for the sheath of each conductor in a given set of conductors compared with any conductor in another set of conductors, must in practice nevertheless possess the same impedance in order for it to be possible for any pair of said cable (single pair or part of a quad) to be used in the same application subsequently. That is why a logical consequence of the above property is that the diameter of the insulating sheath of each conductor wire in a set of conductors of a cable unit of the invention is different from the diameter of the insulating sheath of each conductor wire in any other set of conductors in the same unit.

In a first embodiment of the invention, the cable of the invention comprises a unit of two conductor quads, said quads being grouped together inside a unit sheath surrounded by a metal screen, an outer covering being placed around said unit comprising two quads placed side by side. A screen continuity wire can be installed parallel to the conductors between the unit sheath and the screen.

In a variant of this embodiment, the quads are merely grouped together inside a covering disposed around said unit of two quads placed side by side, the covering generally being constituted by a tape that acts as a screen. In this variant, no use is made of a unit sheath or of a continuity wire.

In a second embodiment of the invention, the cable of the invention comprises a unit of four pairs of conductors, said pairs being grouped together with a unit sheath that is surrounded by a metal screen, an outer covering being placed around said unit of four pairs placed side by side in a manner that is conventional for the person skilled in the art. A screen continuity wire can be installed parallel to the conductors between the unit sheath and the screen.

In a variant of this embodiment, the four pairs are merely grouped together inside a covering disposed around said unit of four pairs placed side by side, the covering generally being constituted by a tape which acts as a screen. In this variant, no use is made of a unit sheath or of a continuity wire.

In a third embodiment of the invention, the cable of the invention comprises a unit of two pairs of conductors, the pairs being grouped together inside a unit sheath surrounded by a metal screen, an outer covering being placed around said unit of two pairs placed side by side. A screen continuity wire can be installed parallel to the conductors between the unit sheath and the screen.

In a variant of this embodiment, the two pairs are merely grouped together inside a covering placed around said unit of two pairs placed side by side, the covering generally being constituted by a tape which acts as a screen. In the context of this variant, no use is made of a unit sheath or of a continuity wire.

In another possible embodiment, when an insulating unit sheath is present, the cable comprises not only the unit(s) of sets of conductors (e.g. quads) surrounded by the insulating unit sheath in the form of a thin covering, but also other elements that are optionally insulating and all of which are disposed inside an outer protective covering, optionally preceded by a metal screen.

Furthermore, in order to facilitate stripping of the conductors, the optional unit sheath may be split longitudinally over all or part of its length.

BRIEF DESCRIPTION OF THE DRAWINGS

Other characteristics and advantages of the present invention appear from the following description of a particular embodiment of the invention given by way of non-limiting illustration.

In the accompanying figures.

In these figures, common elements are given the same reference numerals.

DETAILED DESCRIPTION OF THE INVENTION

Figure 1:
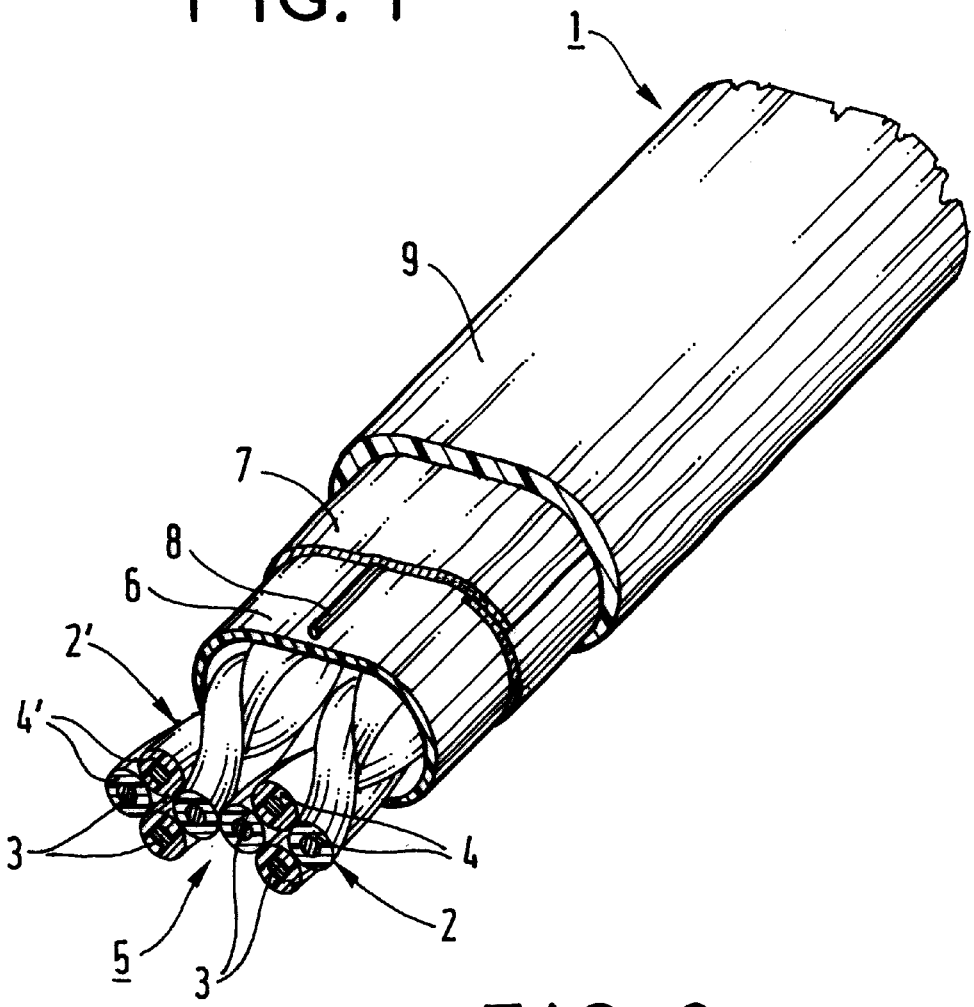
FIG. 1 is a cutaway perspective view of a cable of the invention.
Figure 2:
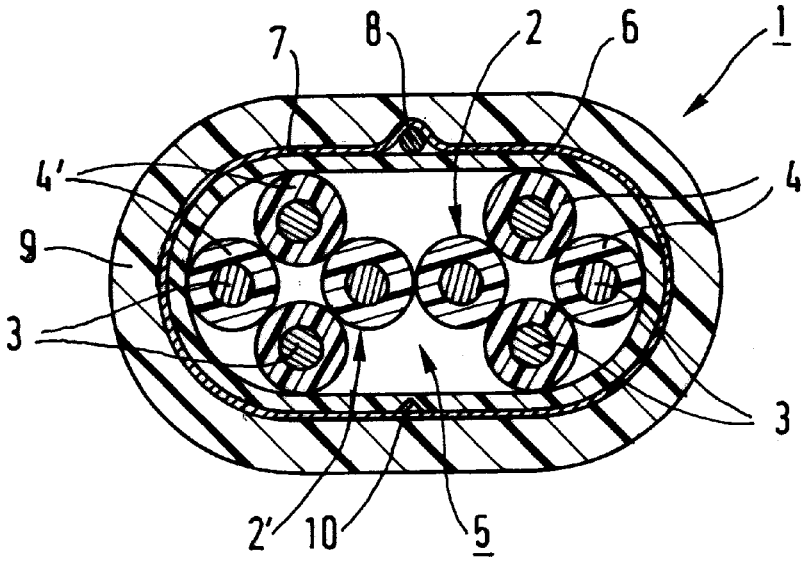
FIG. 2 is a section view of said FIG. 1 cable.

FIGS. 1 and 2 show a flat cable 1 of the invention. The cable 1 comprises two quads 2 and 2'. Each quad 2 or 2' is constituted by four solid copper conductors 3 that are twisted together, each of the conductors being insulated by a first insulating sheath 4 or 4'.

For the quad 2, the solid conductors 3 have a diameter of 0.51 mm (±3 μm), and the diameter of the conductors 3 as insulated by the sheaths 4 is 1.2 mm. Each sheath 4 is of solid polyethylene having a relative dielectric constant of 2.28 and a tangent δ equal to about $2\times10^{-4}$ at 100 kHz. The pitch of the quad is 41.8 mm.

For the quad 2', the solid conductors 3 have a diameter of 0.51 mm (±3 μm), and the diameter of the conductors 3 as insulated by the sheaths 4' is 1.15 mm. Each sheath 4' is made of expanded polyethylene having a relative dielectric constant of 2.26 and a tangent δ equal to about $2\times10^{-4}$ at 100 kHz. The quad is twisted at a pitch of 33.0 mm.

The quads 2 and 2', placed side by side, are grouped together in a two-quad unit referenced 5. The unit 5 is surrounded by an insulating unit sheath 6 situated directly in contact with the insulating conductors (3, 4; 3, 4'). The sheath 6 is conventional and is constituted by a thin covering of polyethylene having a thickness of 0.25 mm to 1 mm. It may be taped or extruded.

A screen 7 in the form of a thin metal foil, e.g. an aluminum-polyester tape wrapped lengthwise, is optionally disposed around the sheath 6. This screen provides shielding to prevent the signals conveyed by the cable being disturbed by external electromagnetic radiation.

A screen continuity wire 8 is disposed between the sheath 6 and the screen 7, parallel to the quads 4 and 4'.

Finally, the unit 5 comprising two insulated and shielded quads is covered in an outer supporting and protective covering 9 of PVC which is extruded around the assembly. The covering 9 gives the cable 1 an oblong structure of dimensions that are approximately equal to 4.3 mm×6.5 mm.

To facilitate stripping the conductors 3 of the cable 1, in particular for the purpose of connecting it to another cable or to some device, the sheath 6 can be cut longitudinally (see FIG. 2) as shown at 10. Furthermore, the material constituting the sheath 6 is selected so that it does not adhere to the material constituting the sheaths 4 and 4' of the conductors 3, still for the purpose of making the conductors easier to strip.

The cable 1 of the invention can be used in particular in local area networks (LANs) for computers, e.g. to connect a floor distribution frame to a user connector.

EXAMPLE

A cable of the invention as described above and as shown in FIGS. 1 and 2 possesses:

a first quad of four identical solid copper conductors each having a diameter of 0.51 mm and each insulated in 1.2 mm of solid polyethylene having a relative dielectric constant of 2.28, with the quad having a pitch of 41.8 mm; and a second quad of four identical solid copper conductors each having a diameter of 0.51 mm and each insulated in 1.15 mm of cellular polyethylene having a relative dielectric constant of 2.26, with the quad having a pitch of 33.0;

the two quads being united in parallel within a small supporting sheath of polyethylene;

said cable also having an aluminum-polyester tape screen wrapped lengthwise and an oblong outer sheath of about 4.3 mm×6.5 mm.

The cable of the invention made in this way possesses a propagation time difference of less than 1 ns/100 m.

By way of comparison, a reference prior art cable of structure similar to that of said cable of the invention but having different conductor insulation thicknesses compared with the cable shown in FIGS. 1 and 2 possesses:

a first quad of four identical solid copper conductors each having a diameter of 0.51 mm and each insulated in 1.1 mm of cellular polyethylene having a dielectric constant of 1.77, with the quad having a pitch of 41.8 mm; and a second quad of four identical solid copper conductors each having a diameter of 0.51 mm and each insulated in 1.1 mm of cellular polyethylene having a dielectric constant of 1.77, with the quad having a pitch of 33.0;

the two quads being united in parallel within a small supporting sheath of polyethylene;

said cable also having an aluminum-polyester tape screen wrapped lengthwise and an oblong outer sheath of about 4.3 mm×6.5 mm.

The reference cable possesses a propagation time difference of about 5 ns/100 m.

Naturally, the invention is not limited to the embodiment described above.

Thus, a cable of the invention can be a cable comprising at least one unit of four pairs disposed at the corners of a square, each pair being twisted and the set of four pairs being twisted as a whole, as is known to the person skilled in the art. This embodiment thus has five different twisting pitches, but naturally only four of the pitches need to be compensated in accordance with the invention by four different materials for the insulating sheaths of the conductors in order to achieve a significant reduction in propagation time differences.

A cable of the invention can also be a cable having at least one unit of two pairs disposed side by side, each pair being twisted and the set of two pairs being twisted as a whole in a manner that is conventional to the person skilled in the art. This embodiment thus has three different twisting pitches, but clearly only two pitches need to be compensated in accordance with the invention by only two different materials for the insulating sheaths of the conductors in order to achieve a significant reduction in propagation time differences.

In another embodiment, when there is an insulating unit sheath, optionally preceded by a metal screen, a cable of the invention can comprise not only the conductor unit(s) surrounded by the insulating unit sheath in accordance with the invention (thin covering), but also other elements, that may be insulating or otherwise (e.g. such as solid conductors), or disposed inside a protective covering.

The screen and the outer protective covering are consequently not necessarily disposed directly in contact with the insulating unit sheath of the invention, in the event of such an insulating unit sheath being present, and it is possible for a cable of the invention to have no screen and/or no outer protective covering.

In a variant, there is no unit sheath as described above and it is the screen which acts as a sheath for the sets of conductors in said unit.

A cable of the invention can also have a dual structure (i.e. a structure that is subdivided into two units), which is typically flat or flattened in shape.

The cable of the invention is not necessarily for use in the field of computers. It can be used in telephony, for example.

What is claimed is:

1. A data transmission cable comprising a unit of at least two sets of twisted conductors, each set of twisted conductors being one of a quad set in which four conductors are twisted together and a pair set in which two conductors are twisted together, and wherein each set of twisted conductors are twisted at a pitch that is different from that of each remaining set of twisted conductors, and wherein each conductor is insulated by a respective insulating sheath, said unit being covered by at least one assembly, and wherein material used for the respective insulating sheath of any conductor in a given set of twisted conductors has a relative dielectric constant that is different from that of material used for the respective insulating sheath of each conductor in each remaining set of twisted conductors such that propagation time differences between the conductors of said given set of twisted conductors and of any other set of twisted conductors is less than 2 ns/100 m.

2. The cable according to claim 1, in which said assembly comprises at least one sheath situated in contact with the conductors of the sets of twisted conductors of the unit.

3. The cable according to claim 1, in which said unit has two sets of twisted conductors, and wherein each set of twisted conductors is a pair set in which two conductors are twisted together.

4. The cable according to claim 3, wherein said two sets of twisted conductor pairs are twisted together as a whole.

5. The cable according to claim 1, in which said unit has two sets of twisted conductors, and wherein each set of twisted conductors is a quad set in which four conductors are twisted together.

6. The cable according to claim 5, wherein which two sets of twisted conductor quads are twisted together as a whole.

7. The cable according to claim 1, in which said unit has four sets of twisted conductors, and wherein each set of twisted conductors is a pair set in which two conductors are twisted together.

8. The cable according to claim 1, in which the material used for the insulating sheath of each conductor in each set of twisted conductors of said cable has a molecular mobility as represented by the tangent value $\delta$, that is less than $5\times10^{-4}$ at 100 kHz.

9. The cable according to claim 1, in which the insulating material used for the insulating sheath of each conductor in said given set of twisted conductors is different from the respective insulating material used for the insulating sheath of each conductor in each remaining set of twisted conductors.

10. The cable according to claim 9, in which said material used for the insulating sheath of each conductor in said given set of twisted conductors is a polyethylene material.

11. The cable according to claim 9, in which said material used for the insulating sheath of each conductor in said given set of twisted conductors is a flourine-containing polymer material.

12. The cable according to claim 1, in which the insulating material used for the insulating sheath of each conductor in said given set of twisted conductors is of a same nature as the insulating material used for the respective insulating sheath of each conductor in each remaining set of twisted conductors but possessing different relative dielectric constants.

13. The cable according to claim 1, in which a diameter of the insulating sheath of each conductor wire of a set of twisted conductors of said unit of said cable is different from a diameter of the insulating sheath of each conductor wire of any other set of conductors of said unit of said cable.

14. A data transmission cable comprising a unit of at least two sets of twisted conductors, each set of twisted conductors including at least two conductors twisted together, and wherein each set of twisted conductors are twisted at a pitch that is different from that of each remaining set of twisted conductors, and wherein each conductor is insulated by a respective insulating sheath, said unit being covered by at least one assembly, and wherein material used for the insulating sheath of each conductor in a given set of twisted conductors has a relative dielectric constant that is different from that of material used for the respective insulating sheath of each conductor in each remaining set of twisted conductors; and wherein said relative dielectric constant of said material used for the insulating sheath of each conductor in said given set of twisted conductors is different from that of said material used for the respective insulating sheath of each conductor in each remaining set of twisted conductors such that propagation time differences between the conductors of said given set of twisted conductors and of any other set of twisted conductors is less than 5 ns/100 m.

15. The data transmission cable according to claim 14, wherein each set of twisted conductors is one of a quad set in which four conductors are twisted together and a pair set in which two conductors are twisted together.

16. The cable according to claim 15, in which said unit has two sets of twisted conductors, and wherein each set of twisted conductors is a pair set in which two conductors are twisted together.

17. The cable according to claim 15, in which said unit has two sets of twisted conductors, and wherein each set of twisted conductors is a quad set in which four conductors are twisted together.

18. The cable according to claim 15, in which said unit has four sets of twisted conductors, and wherein each set of twisted conductors is a pair set in which two conductors are twisted together.

19. The cable according to claim 14, in which the material used for the insulating sheath of each conductor in each set of twisted conductors of said cable has a molecular mobility as represented by the tangent value $\delta$, that is less than $5\times10^{-4}$ at 100 kHz.

20. The cable according to claim 14, in which the insulating material used for the insulating sheath of each conductor in said given set of twisted conductors is different from the respective insulating material used for the insulating sheath of each conductor in each remaining set of twisted conductors.

21. The cable according to claim 20, in which said material used for the insulating sheath of each conductor in said given set of twisted conductors is a polyethylene material.

22. The cable according to claim 20, in which said material used for the insulating sheath of each conductor in said given set of twisted conductors is a flourine-containing polymer material.

23. The cable according to claim 14, in which the insulating material used for the insulating sheath of each conductor in said given set of twisted conductors is of a same nature as the insulating material used for the respective insulating sheath of each conductor in each remaining set of twisted conductors but possessing different relative dielectric constants.

24. The cable according to claim 14, in which a diameter of the insulating sheath of each conductor wire of a set of twisted conductors of said unit of said cable is different from a diameter of the insulating sheath of each conductor wire of any other set of conductors of said unit of said cable.

25. The data transmission cable according to claim 14, wherein said relative dielectric constant of said material used for the insulating sheath of each conductor in said given set of twisted conductors is different from that of said material used for the respective insulating sheath of each conductor in each remaining set of twisted conductors such that propagation time differences between the conductors of said given set of twisted conductors and of any other set of twisted conductors is less than 1 ns/100 m.

* * * * *